US008387317B2

(12) United States Patent
Kugler et al.

(10) Patent No.: US 8,387,317 B2
(45) Date of Patent: Mar. 5, 2013

(54) SYSTEMS AND SUPPORT ASSEMBLIES FOR RESTRAINING ELEVATED DECK COMPONENTS

(75) Inventors: William E. Kugler, Denver, CO (US); Stephen J. Knight, III, Littleton, CO (US)

(73) Assignee: United Construction Products, Inc., Denver, CO (US)

( * ) Notice: Subject to any disclaimer, the term of this patent is extended or adjusted under 35 U.S.C. 154(b) by 35 days.

(21) Appl. No.: 13/094,364

(22) Filed: Apr. 26, 2011

(65) Prior Publication Data

US 2012/0272588 A1 Nov. 1, 2012

(51) Int. Cl.

| | |
|---|---|
| ***E04B 2/82*** | (2006.01) |
| ***E04B 9/00*** | (2006.01) |
| ***E04B 1/00*** | (2006.01) |
| ***E04B 5/00*** | (2006.01) |
| ***E04G 1/22*** | (2006.01) |

(52) U.S. Cl. ..... 52/126.6; 52/126.5; 52/126.7; 52/126.1; 52/263; 52/100

(58) Field of Classification Search ..... 52/126.6, 52/126.5, 126.7, 126.1, 263, 100
See application file for complete search history.

(56) References Cited

U.S. PATENT DOCUMENTS

| | | | | |
|---|---|---|---|---|
| 4,085,557 | A * | 4/1978 | Tharp | 52/263 |
| 4,279,109 | A | 7/1981 | Madl, Jr. | |
| 4,922,670 | A * | 5/1990 | Naka et al. | 52/126.6 |
| 4,996,804 | A | 3/1991 | Naka et al. | |
| 5,072,557 | A | 12/1991 | Naka et al. | |
| 5,333,423 | A | 8/1994 | Propst | |
| 5,588,264 | A | 12/1996 | Buzon | |
| 5,791,096 | A * | 8/1998 | Chen | 52/126.6 |
| 6,189,289 | B1 * | 2/2001 | Quaglia et al. | 52/764 |
| 6,363,685 | B1 | 4/2002 | Kugler | |
| 6,550,195 | B1 * | 4/2003 | Cooper et al. | 52/220.3 |
| 6,604,330 | B2 | 8/2003 | Repasky | |
| 6,983,570 | B2 | 1/2006 | Mead | |
| 7,140,156 | B1 * | 11/2006 | Lowe et al. | 52/263 |
| 7,360,343 | B1 * | 4/2008 | Spransy et al. | 52/263 |
| 7,386,955 | B1 * | 6/2008 | Repasky | 52/126.6 |
| 7,650,725 | B2 * | 1/2010 | Mead | 52/263 |
| 2001/0011441 | A1 * | 8/2001 | Jette | 52/220.1 |
| 2002/0014045 | A1 * | 2/2002 | Jette | 52/220.1 |
| 2002/0148173 | A1 | 10/2002 | Kugler | |
| 2004/0035064 | A1 | 2/2004 | Kugler et al. | |

(Continued)

OTHER PUBLICATIONS

Eternoivica Catalogue Price List, pp. 58-67, dated 2008.

(Continued)

*Primary Examiner* — Mark Wendell
(74) *Attorney, Agent, or Firm* — Marsh Fischmann & Breyfogle LLP

(57) ABSTRACT

A system for restraining relative lateral and/or vertical movement between adjacent support tiles of an elevated building surface assembly. The system is usable with a support structure including a plurality of support pedestals that are disposed in spaced-apart relation on a fixed surface and that are disposed beneath corner portions of surface tiles to vertically support and elevate the tiles above the fixed surface. The system includes stability members that may be inserted into predetermined gaps between adjacent surface tiles so as to be fit between adjacent surface tiles to restrict lateral and/or vertical movement of the tiles. Fasteners may be placed through apertures in inner portions of the stability members into the top surface of the support pedestals to further secure the stability members to the support pedestals.

32 Claims, 7 Drawing Sheets

U.S. PATENT DOCUMENTS

| | | | | |
|---|---|---|---|---|
| 2004/0261329 | A1 | 12/2004 | Kugler et al. | |
| 2005/0066597 | A1* | 3/2005 | Chen et al. | 52/263 |
| 2010/0051763 | A1 | 3/2010 | Knight, III et al. | |
| 2010/0281789 | A1* | 11/2010 | Vac | 52/126.5 |
| 2011/0011012 | A1 | 1/2011 | Knight, III et al. | |
| 2011/0016809 | A1 | 1/2011 | Knight, III et al. | |
| 2011/0023385 | A1 | 2/2011 | Knight, III et al. | |
| 2011/0239550 | A1* | 10/2011 | Kugler et al. | 52/126.6 |

OTHER PUBLICATIONS

Brochure entitled Exotic Wood Tile Installation, Bison Deck Supports, a United Construction Products, Inc. Company, dated Jun. 2007.

Ironwoods Elevated Deck Tile Systems with Hanover Pedestals, Website retrieved Jun. 12, 2009.

* cited by examiner

SYSTEMS AND SUPPORT ASSEMBLIES FOR RESTRAINING ELEVATED DECK COMPONENTS

FIELD OF THE INVENTION

This invention relates to the field of systems support structures for supporting and restraining an elevated surface above a fixed surface, such as support structures to elevate surface tiles for elevated floors, decks and walkways.

DESCRIPTION OF RELATED ART

Elevated building surfaces such as elevated floors, decks, terraces and walkways are desirable in many environments. One common system for creating such surfaces includes a plurality of surface tiles, such as concrete tiles (e.g., pavers), stone tiles or wood tiles, and a plurality of spaced-apart support pedestals upon which the tiles are placed to be supported above a fixed surface. For example, in outdoor applications, the surface may be elevated above a fixed surface by the support pedestals to promote drainage, to provide a level structural surface for walking, and/or to prevent deterioration of or damage to the surface tiles. The pedestals can have a fixed height, or can have an adjustable height such as to accommodate variations in the contour of the fixed surface upon which the pedestals are placed, or to create desirable architectural features.

Although a variety of shapes are possible, in many applications the surface tiles are generally rectangular in shape, having four corners. In the case of a rectangular shaped tile, each of the spaced-apart support pedestals can support four adjacent surface tiles at the tile corners. Stated another way, each rectangular surface tile can be supported by four pedestals that are disposed under each of the corners of the tile. Large or heavy tiles can be supported by additional pedestals at positions other than at the corners of the tiles.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The support pedestal generally includes a threaded base member and a threaded support member that is threadably engaged with the base member to enable the height of the support pedestal to be adjusted by rotating the support member or the base member relative to the other. The support pedestal can also include a coupling or coupler member disposed between the base member and the support member for further increasing the height of the pedestal, if necessary. Alternatively, support or coupler members may be in the form of a pipe or box-shaped support that may be cut to length.

Support pedestals are also disclosed in U.S. Pat. No. 6,363,685 by Kugler and U.S. Patent Application Pub. No. 2004/0261329 by Kugler et al., each of which is also incorporated herein by reference in its entirety.

SUMMARY OF THE INVENTION

One problem associated with some support structures for elevated surfaces is that the support structures may not adequately restrict relative lateral and/or vertical movement between adjacent surface tiles. This failure of current support structures may become more pronounced when the support structures are utilized in seismically active geographic areas or other locations that may be subject to disruptive vibrations of the fixed surface upon which the support structures are placed, such as exterior environments that are subject to high wind conditions. More particularly, disruptive vibrations or wind may cause relative lateral and/or vertical movement between surface tiles when the surface tiles are not adequately restricted from such relative movement, and this situation may result in increased stress being placed on the surface tiles (e.g., when adjacent surface tiles strike one another) and on the support structure itself.

It is therefore an objective to provide a support assembly structure or system for an elevated surface that has improved structural stability compared to existing support structures, particularly in areas that are prone to disruptive vibrations and/or high winds. In one embodiment, a system for supporting a plurality of building surface tiles is provided. The system includes a plurality of support pedestals, the support pedestals comprising a support plate having a top surface for operatively supporting corner portions of a plurality of building surface tiles in horizontally spaced-apart relation. A plurality of stability members are also provided that are adapted to be disposed over the support plates and between building surface tiles, the stability members comprising at least first and second stabilizing arms extending away from an inner portion of the stability members, where the stabilizing arms have a top edge, a bottom edge, and at least a first tile engaging element protruding from each of the first and second stabilizing arms between the top edge and the bottom edge.

The foregoing embodiment is subject to a number of characterizations. In one characterization, the stabilizing arms further comprise at least a second tile engaging element protruding from each of the first and second stabilizing arms between the top edge and the bottom edge. For example, the first tile engaging element may protrude from a first side of the first and second stabilizing arms and the second tile engaging element may protrude from a second side of the first and second stabilizing arms. In this regard, the first and second tile engaging elements may be comprised of longitudinally extending ribs protruding from a surface of the stabilizing arms, may comprise an arcuate surface portion longitudinally extending along the first and second stabilizing arms, or may comprise an oblique surface portion longitudinally extending along the first and second stabilizing arms. The stabilizing arms may also comprise a hollow portion adjacent to at least the first tile engaging element.

In another characterization, the stability members may include a vertically extending aperture disposed in the inner portion of the stability members. For example, a plurality of mechanical fasteners may be provided that are adapted to be placed through the apertures to secure the stability members to the support plates.

In another characterization, the first and second stabilizing arms may be disposed at an angle of about 180° (e.g., may be co-planar and/or co-linear). Further, the stability members may further comprise third and fourth stabilizing arms extending away from the inner portion of the stability members, such as where the third and fourth stabilizing arms are orthogonally disposed relative to the first and second stabilizing arms. In this regard, the stability members may also include a vertically extending aperture disposed in the inner portion of the stability members, and a plurality of mechanical fasteners adapted to be placed through the apertures may be provided to secure the stability members to the support plates. The stability members may comprise a material selected from the group consisting of wood, natural stone, concrete, metal, polymers, plastic or composites thereof.

The support pedestals are also subject to a number of characterizations, and in one characterization the support pedestals include a base plate and a central section interconnecting the base plate and the support plate.

According to another embodiment, a system for supporting a plurality of building surface tiles is provided. The system may include a plurality of support pedestals, the support pedestals comprising a support plate having a top surface for operatively supporting corner portions of a plurality of building surface tiles in horizontally spaced-apart relation. The system may also include a plurality of stability members comprising at least first and second stabilizing arms extending away from an inner portion of the stability members, where the stabilizing arms have a first thickness proximal to a bottom edge and a second thickness proximal to a top edge, where the second thickness is greater than the first thickness. A plurality of mechanical fasteners that are adapted to be placed through the inner portion of the stability members to secure the stability members to the support plates may also be provided.

The foregoing embodiment may also be subject to a number of characterizations. For example, the support plates may comprise a plurality of spacer tabs protruding upwardly from the top surface of the support pedestals. In this regard, the second thickness of the stabilizing arms may be greater than the thickness of the spacer tabs, and the stabilizing arms may be adapted to be disposed over the spacer tabs. For example, the bottom edge of the stabilizing arms may comprise a notch that is adapted to be placed over the spacer tab.

In another characterization, the stabilizing arms may have a height that is not greater than the thickness of the surface tiles. In this manner, the stabilizing arms may be disposed flush with or beneath a top surface of the surface tile. For example, the stabilizing arms may have a height that is not greater than about 2 inches.

In another characterization, the stabilizing arms may include longitudinally extending ribs protruding from a surface of the stabilizing arms proximate to the top edge of the stabilizing arms. In another characterization, the thickness of the stabilizing arms may taper (e.g., generally decrease in thickness) from the top edge towards the bottom edge. The first and second stabilizing arms may also be disposed at an angle of about 180°, for example.

In another characterization, the plurality of stabilizing members comprise a first stabilizing element having an aperture that is adapted to be placed in vertical alignment over an aperture in a second stabilizing element, e.g., where each stabilizing element includes two stabilizing arms extending away from an inner portion of the stabilizing elements. In another characterization, the plurality of stabilizing members also include a third stabilizing arm and a fourth stabilizing arm extending away from the inner portion of the stabilizing members. For example, the third and fourth stabilizing arms may be orthogonally disposed relative to the first and second stabilizing arms. The stabilizing members may further comprise an aperture through the inner portion of the stability members, wherein the mechanical fasteners are adapted to be disposed through the apertures, such as to secure the stabilizing members to the support pedestals. The stability members may comprise a material selected from the group consisting of wood, natural stone, concrete, metal, polymers, plastic or composites thereof.

The support pedestals are also subject to a number of characterizations. For example, the support pedestals may include a base plate and a central section interconnecting the base plate and support plate.

In another embodiment, an elevating building surface assembly is provided. The assembly may include a plurality of building surface tiles, the building surface tiles comprising a top surface, an outer edge having an edge thickness and a plurality of corner portions. At least one support pedestal is provided, the support pedestal being disposed beneath the corner portions of adjacent building surface tiles to vertically support and elevate the building surface tiles above a fixed surface, the support pedestal comprising a support plate having a top surface that supports the building surface tiles. At least one stability member is disposed within a gap between adjacent building surface tiles, wherein the stability member comprises at least first and second stabilizing arms extending away from an inner portion of the stability member, where the stabilizing arms have a top edge, a bottom edge, and at least a first tile engaging element protruding from each of the first and second stabilizing arms between the top edge and the bottom edge.

In accordance with this embodiment, the stabilizing arms may further include at least a second tile engaging element protruding from each of the first and second stabilizing arms between the top edge and the bottom edge. For example, the first tile engaging element may protrude from a first side of the first and second stabilizing arms and the second tile engaging element may protrude from a second side of the first and second stabilizing arms. In this regard, the first and second tile engaging elements may comprise longitudinally extending ribs protruding from the surface of the stabilizing arms. Alternatively, the first and second tile engaging elements may comprise an arcuate surface portion or an oblique surface portion longitudinally extending along the first and second stabilizing arms.

In another characterization, the outer edges of the building surface tiles may comprise stability member engaging portions, such as a notch for receiving the tile engaging element. Further, the stability member may be disposed beneath the top surface of the building surface tiles.

In another embodiment, an elevated building surface assembly is provided that includes a plurality of building surface tiles, the building surface tiles comprising a top surface, an outer edge having an edge thickness and a plurality of corner portions. At least one support pedestal is disposed beneath the corner portions of adjacent building surface tiles to vertically support and elevate the building surface tiles above a fixed surface, the support pedestal comprising a support plate having a top surface that supports the building surface tiles. The assembly also includes at least one stability member comprising at least a first stabilizing arm that is disposed within a gap between adjacent building surface tiles, wherein the first stabilizing arm comprises at least a first tile engaging element protruding from the stabilizing arm between a top edge and a bottom edge of the stabilizing arm, wherein the outer edges of the building surface tiles comprise stability member engaging portions, and wherein the first tile engaging element is operatively engaged with a stability member engaging portion.

In one characterization, the first tile engaging element comprises a protrusion on a surface of the stabilizing arm and the stability member engaging portions comprise a notch for receiving the protrusion. For example, each building surface tile may include a plurality of outer edges where adjacent outer edges meet at a corner, wherein each notch intersects at least two adjacent outer edges at a corner of a building surface tile.

In another characterization, the stability member is disposed beneath the top surface of the building surface tiles. In yet another characterization, the first stabilizing arm further comprises at least a second tile engaging element protruding from a side of the first stabilizing arm opposite the first tile engaging element, wherein the first tile engaging element is engaged with a stability member engaging portion of a first adjacent building surface tile, and wherein the second tile engaging element is engaged with a stability member engaging portion of a second adjacent building surface tile.

In another characterization, a mechanical fastener secures the stability member to the support plate. In yet another characterization, the stability member further comprises a second stabilizing arm, wherein the first and second stabilizing arms extend away from an inner portion of the stability member. In this regard, the stability member may include an aperture disposed in the inner portion of the stability member. The stability member may also comprise a third stabilizing arm and a fourth stabilizing arm extending away from the inner portion of the stability member, such as where the third and fourth stabilizing arms are orthogonally disposed relative to the first and second stabilizing arms.

In another characterization, a predetermined gap width of the gap is at least about 0.05 inch and is not greater than about 0.5 inch.

In yet another embodiment, an elevated building surface assembly is provided. The assembly may include a plurality of building surface tiles, the building surface tiles comprising a top surface, an outer edge having an edge thickness, and a plurality of corner portions. The assembly also includes a plurality of support pedestals, the support pedestals being disposed beneath the corner portions of the plurality of building surface components to vertically support and elevate the building surface components above a fixed surface to form an elevated building surface, the support pedestals comprising a support plate having a top surface that receives corner portions of the building surface components. A plurality of stability members are provided that comprise at least first and second stabilizing arms extending away from an inner portion of the stability members, where the stabilizing arms have a first thickness proximal to a bottom edge and a second thickness proximal to a top edge, where the second thickness is greater than the first thickness, wherein the stability members are disposed within gaps between adjacent building surface tiles to restrict lateral and/or vertical movement of the building surface tiles.

In one characterization, the stability members are disposed below the top surface of the building surface tiles. In another characterization, the assembly includes a plurality of fasteners extending through the stability members and into the support plates to secure the stability members to the support pedestals. In yet another characterization, the stability members comprise an inner portion, and wherein the stabilizing arms extend away from the inner portion.

In another embodiment, a method for the construction of an elevated building surface assembly is provided. The method may include locating a plurality of support pedestals upon a fixed surface with a predetermined spacing between the support pedestals. Corner portions of building surface tiles may then be placed upon a top surface of the support pedestals, and first securing portions disposed on outer edges of the building surface tiles may be engaged with first tile engaging elements disposed on stabilizing arms of stability members disposed over the top surface of the support pedestals. In this regard, the stability members define a gap between adjacent building surface tiles, the gap comprising a gap width, and wherein engagement of the first securing portion and the first tile engaging element restricts movement of the building surface tiles away from the support pedestals.

In one characterization, the method may also include the step of securing the stability members to the top surfaces of the support pedestals, such as by extending mechanical fasteners through the stability members and into the top surfaces of the support pedestals. For example, screws may be threaded through the stability member and into the top surfaces of the support pedestals. According to another characterization, the gap width is at least about 0.05" and is not greater than about 0.5".

DESCRIPTION OF THE INVENTION

Figure 1:
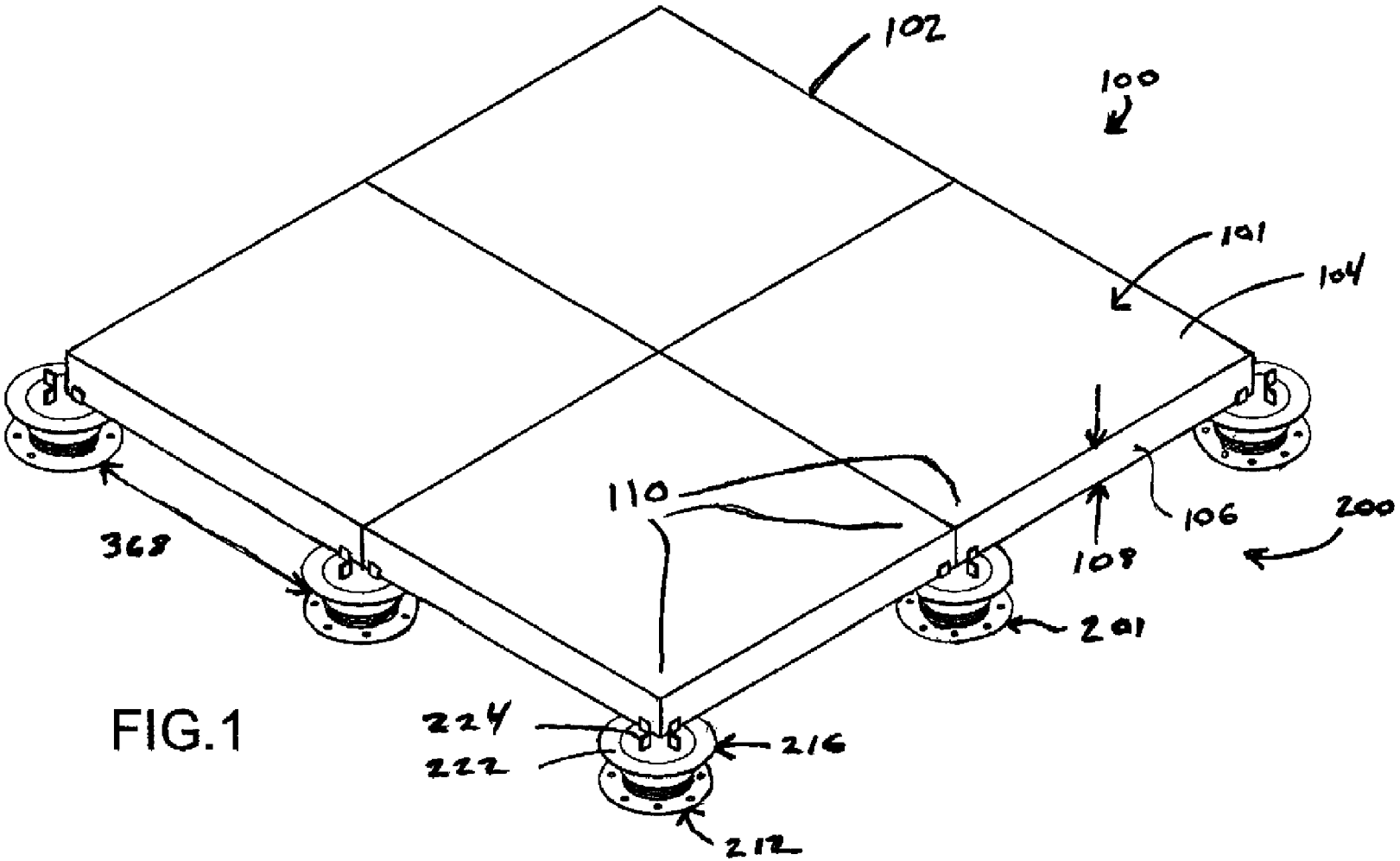
FIG. 1 illustrates a perspective view of an elevated building surface assembly.

FIG. 1 illustrates a portion of an elevated building surface assembly 100 that includes a building surface 101 formed from a plurality of surface tiles 102 that are elevated above a fixed surface (not shown) by a support structure 200. The support structure 200 includes a plurality of spaced-apart support pedestals 201, each of which is adapted to be disposed beneath corner portions of adjacent surface tiles 102 to support the surface tiles 102 above the fixed surface.

The surface tiles 102 can be comprised of virtually any material from which a building surface is constructed. Examples include, but are not limited to, slate tiles, natural stone tiles, plastic tiles, composite tiles, concrete tiles (e.g., pavers), wooden deck tiles, including hardwood deck tiles, tiles of metal or fiberglass grating, rubber tiles and the like. The support pedestals 201 can be placed in a spaced-apart relation on fixed surfaces including, but not limited to, rooftops, on-grade (e.g., natural ground), over concrete slabs including cracked concrete slabs, and can be placed within fountains and water features, used for equipment mounts, and the like. The elevated building surface assembly 100 can be used for both interior and exterior applications.

Each surface tile 102 may be placed upon several support pedestals 201 to elevate the surface tile 102 above the fixed surface. As illustrated in FIG. 1, the surface tiles 102 may be square or any other appropriate shape (e.g., regular polygonal shapes such as hexagonal) and a support pedestal 201 may be disposed beneath the corners (e.g., 4 corners) of adjacent surface tiles 102. As shown, each surface tile 102 may include a top surface 104, an outer edge 106 having an edge thickness 108, and a plurality of corner portions 110. Further, although illustrated in FIG. 1 as being laid out in a symmetric square pattern, the support pedestals 201 may also be laid out in various configurations as may be dictated by the shape and size of the surface tiles, such as a rectangular configuration or a triangular configuration.

The plurality of support pedestals may be any combination of fixed-height and/or height-adjustable support pedestals constructed of any appropriate materials (e.g., plastic, composites). For example, referring to FIG. 2, the support pedestal 201 may broadly include a base member 212 including a base member extension 214 (e.g., a cylindrical base member extension) that extends upwardly from a base member plate 215 (e.g., a base plate) when the support pedestal 201 is operatively placed on a fixed surface. The base member 212 may include base member threads on a surface of the base member extension 214, e.g., internal or external threads.

A support member 216 is adapted to be operatively connected to the base member 212 and includes a support plate 220 and a support member extension 219 (e.g., a cylindrical support member extension) that extends downwardly from the support plate 220. The support member 216 may include support member threads, e.g., external or internal threads, on the support member extension 219 that are adapted to threadably engage base member threads to connect the support member 216 to the base member 212 and more specifically to operatively attach the support member extension 219 to the base member extension 214. Thus, the support member 216 can be mated directly to base member threads 218 and can be rotated relative to the base member 212 (or vice versa) to adjust the height of the support pedestal 201. The support plate 220 is thereby disposed above the base member 212 to support surface tiles thereon.

Figure 2:
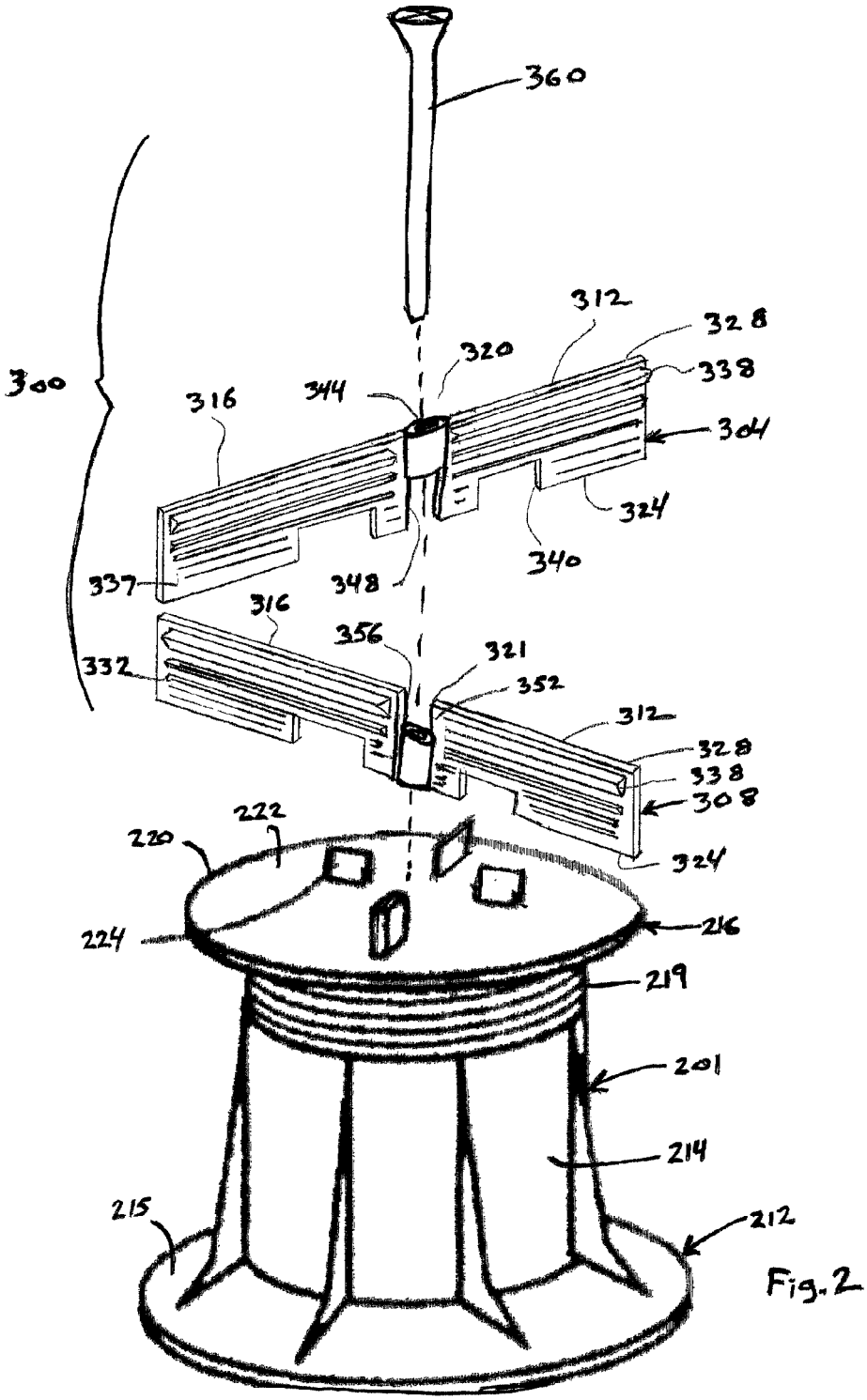
FIG. 2 illustrates an exploded perspective view of a support pedestal and a stability member usable with the stabilized elevated building surface assembly of FIG. 1.

In one variation, the support pedestal 201 may include at least one coupling member (not shown) extending between the base member extension 214 and the support member extension 219 that operatively attaches the base member extension 214 to the support member extension 219 and that is adapted to increase the height of the support pedestal 201. Additionally, although illustrated as having external threads on the support member 216 and internal threads on the base member 218, it will be appreciated that other configurations are possible. See, for example, U.S. Pat. No. 5,588,264 by Buzon and U.S. Pat. No. 6,363,685 by Kugler, each of which is incorporated herein by reference in its entirety. The support pedestal may also have a fixed height. It should be appreciated that the support pedestal 201 may, from a broad perspective, be in the form of the base member plate 215, the support plate 220, and a "support pillar" or "central section" interconnecting the base and support plates 215, 220. As shown in FIG. 2, the central section is made up of the base member extension 214 and the support member extension 219, although in other embodiments, the central section may be a single, fixed-height member.

In any event, the support plate 220 includes a top surface 222 upon which the corner portions 110 of adjacent surface tiles 102 can be placed. Spacer tabs 224 may optionally be provided on the top surface 222 of the support plate 220 to provide predetermined gaps 226 (see FIG. 3) between adjacent surface tiles 102 that form the elevated building surface. That is, the predetermined gaps 226 may have gap widths 227 that are approximately equal to a width of the spacer tabs 224. For instance, the gap widths 227 may be at least about 0.05" and not greater than about 0.5". Moreover, the spacer tabs 224 may be disposed on a crown member (not illustrated) that is placed in a recess on the top surface of the support plate 220. In this manner, the crown member can be rotated independent of the support member 216 to adjust the position of the spacer tabs 224.

With continued reference to FIG. 2, a stability member 300 is illustrated that may be used in conjunction with or as part of the support structure 200 to restrain relative lateral and/or vertical movement between adjacent surface tiles. The stability member 300 is operable to be placed within the predetermined gap between adjacent surface tiles (e.g., see FIG. 4) to limit such lateral and/or vertical movement between the surface tiles 102. For example, the stability member 300 may be compression fit into the gap. In this regard, the elevated building surface assembly 100 of FIG. 1 may be more likely to move as a single unit and thus less likely to sustain damage during vibratory disruptions or wind events.

Figure 3:
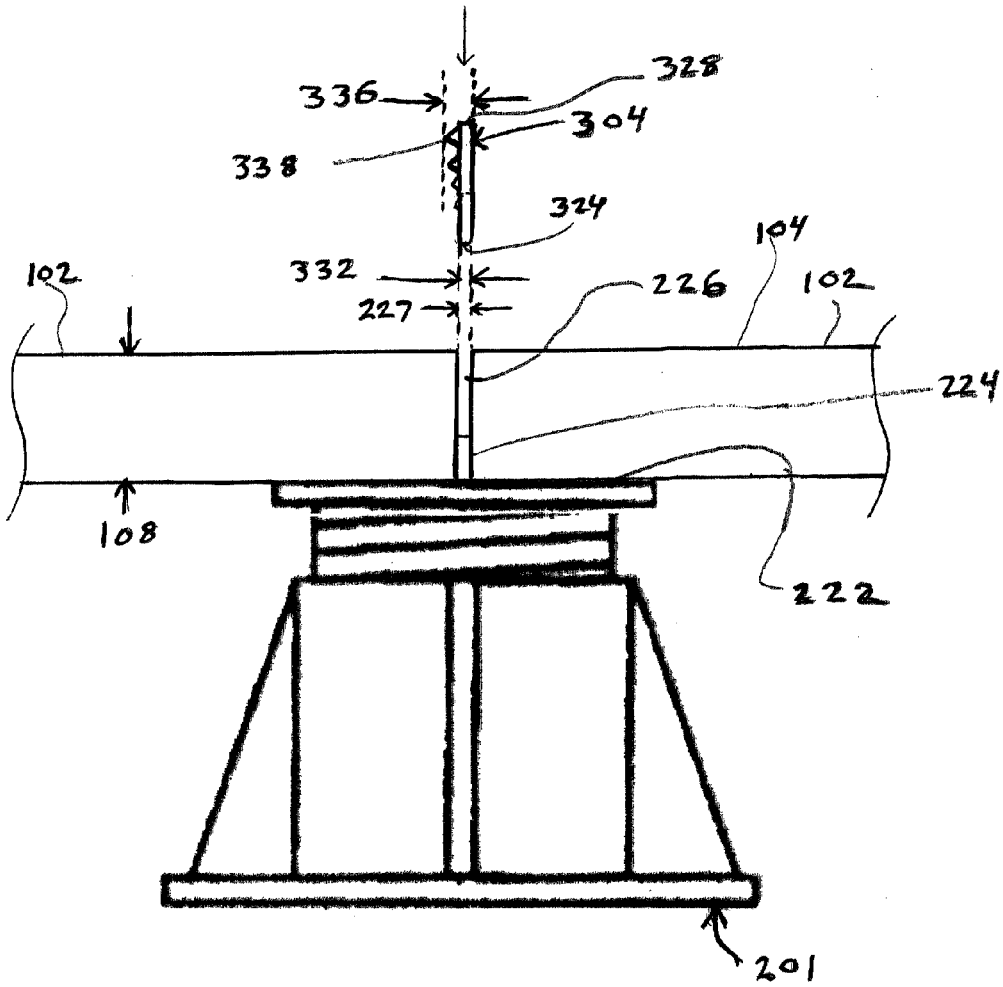
FIG. 3 illustrates a side elevation view of a stabilizing arm of the stabilizing member of FIG. 2 being inserted into a gap between adjacent surface tiles on a support pedestal.
Figure 4:
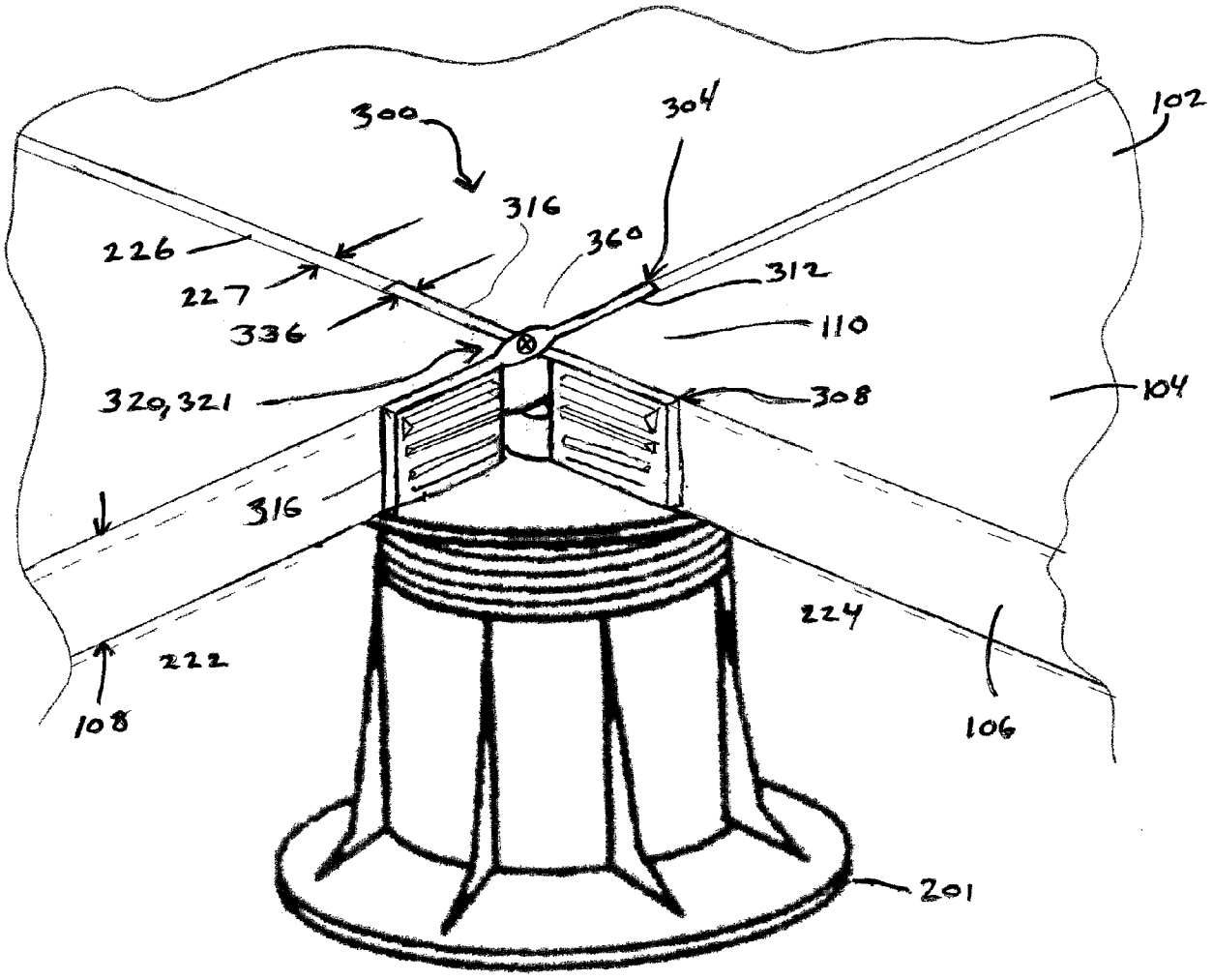
FIG. 4 illustrates a perspective view of a portion of the stabilized elevated building surface assembly of FIG. 1 having the stabilizing arm of FIG. 2 restraining lateral and/or movement between adjacent surface tiles, where one surface tile has been removed for clarity.

As seen in FIGS. 2-4, the stability member 300 may include first and second stability segments 304, 308 that are operable to be compression-fit into the predetermined gaps 226 between adjacent surface tiles 102. The first and second stability segments 304, 308 may each include first and second stabilizing arms 312, 316 that extend away from respective inner portions 320, 321 at any appropriate angle (e.g., 180°). As will be described in more detail below, the first and second stability segments 304, 308 may be similar in all substantive respects except for the inner portions 320, 321. This arrangement may facilitate the attachment of the first and second stability segments 304, 308 to an underlying support pedestal.

The first and second stabilizing arms 312, 316 may include a bottom edge 324 that is generally adapted to face towards and/or contact the top surface 222 of the support pedestal 201 and a top edge 328 that is generally adapted to face away from the top surface 222 when the stability member 300 is installed with the elevated building surface assembly 100. The first and second stabilizing arms 312, 316 may include a first thickness 332 proximal to the bottom edge 324 and a second thickness 336 proximal to the top edge 328. As seen in FIG. 3, the second thickness 336 may be greater than the first thickness 332 (i.e., before the first and second stabilizing arms 312, 316 are compression fit into the gaps 226) and the first and second stabilizing arms 312, 316 may be designed such that the overall thickness of the first and second stabilizing arms 312, 316 generally tapers (i.e., generally decreases in thickness) from or near the top edge 328 towards the bottom edge 324. For instance, each of the first and second stabilizing arms 312, 316 may include a series of tile engaging elements 338 (e.g., teeth or ribs) protruding outwardly from a front surface 337 thereof that generally decrease in size (e.g., thickness) in a direction from the top edge 328 towards the bottom edge 324.

Constructing the second thickness 336 to be greater than the first thickness 332, or in other words designing the first and second stabilizing arms 312, 316 to taper in thickness as discussed above, may facilitate initial insertion of the first and second stabilizing arms 312, 316 into the gaps 226 and/or subsequent compression fitting of the first and second stabilizing arms 312, 316 between adjacent surface tiles 102. Additionally, the tile engaging elements 338 may serve to increase the wedging or binding between the stability member 300 and the surface tiles 102 (i.e., may limit the surface tiles 102 from moving away from the support plate 220 of the support pedestal 201). In some embodiments, tile engaging elements 338 (e.g., longitudinally extending ribs) may be provided on both the front surface 337 and a rear surface (not shown) of the first and second stabilizing arms 312, 316. In other embodiments, the first and second stabilizing arms 312, 316 may not include tile engaging elements 337 while the overall thickness of the first and second stabilizing arms 312, 316 still generally tapers from or near the top edge 328 towards the bottom edge 324. In further embodiments, the first and second stabilizing arms 312, 316 may have a generally constant thickness from the top edge 328 towards the bottom edge 324, or the bottom edge 324 may be pointed or rounded.

As seen in FIG. 4, the first and second stabilizing arms 312, 316 may be adapted to be placed into the predetermined gap 226 such that the top edge 328 is generally disposed substantially level with or below the top surface 104 of the surface tiles 102. In this regard, the first and second stabilizing arms 312, 316 may include one or more notches 340 (FIG. 2) in the bottom edges 324 that are sized to receive the spacer tabs 224. That is, the notch 340 may be of a shape that generally conforms to the shape of a respective spacer tab 224. In one arrangement, the first and second stabilizing arms 312, 316 of the first and second stability segments 304, 308 include one or more notches to accommodate spacer tabs 224 protruding or extending upwardly from the top surface 222 of the support plate 220.

The inner portion 320 of the first stability segment 304 may include an aperture 344 therein and a first interlocking space 348 disposed adjacent (e.g., below) the first aperture 344. Similarly, the inner portion 321 of the second stability segment 308 may include an aperture 352 therein, and a second interlocking space 356 disposed adjacent (e.g., above) the aperture 352. With reference to FIG. 2, the first and second stability segments 304, 308 may be identical in all respects except for the location of the first and second apertures 344, 352 and the first and second interlocking spaces 348, 356. More specifically, the inner portions 320, 321 of the first and second stability segments 304, 308 may essentially be mirror images of each other to allow the first and second interlocking spaces 348, 356 to interlock and the first and second apertures 344, 352 to thereby become collinear (e.g., as seen in FIG. 4). Stated otherwise, the first aperture 344 of the first stability segment 304 is adapted to be placed in vertical alignment over the second aperture 352 of the second stability segment 308. It should also be noted that the inner portions 320, 321 may have an elongate shape such as an oblong rectangle or an oval shape to enable the inner portions 320, 321 to fit between the surface tiles 104, although the inner portions 320, 321 may deform when installed.

Once so positioned, the first and second stability segments 304, 308 may be disposed at approximately right angles (e.g., orthogonally) relative to each other (i.e., the first and second stabilizing arms 312, 316 of the stability segment 304 may be disposed at approximately right angles to the first and second stabilizing arms 312, 316 of the second stability segment 308). Additionally, the first and second stability segments 304, 308 may also be pivoted relative to each other about an axis that runs through the first and second apertures 344, 352 to allow the first and second stability segments 304, 308 to adjust and accommodate various designs of building surfaces 101.

In any event, the stability member 300 may also include at least one mechanical fastener 360 (e.g., bolt, screw) that may be inserted (e.g., threaded) through the first and second apertures 344, 352 and into the top surface 222 of the support plate 220 to secure the stability member 300 to the support pedestal 201 and thereby restrain lateral and/or vertical movement of the surface tiles 102 of the building surface 101. Before discussing a method for constructing an elevated building surface assembly using the stability member 300, it should be appreciated that numerous other arrangements and embodiments of the stability member 300 are envisioned.

In one arrangement, the first and second stability segments 304, 308 may effectively function as a single/first stability unitary member that includes for example first, second, third and fourth stabilizing arms, all of which extend away from an inner portion of the stability member such that the first and second stabilizing arms are disposed substantially orthogonally to the third and fourth stabilizing arms. In this arrangement, it is envisioned that the first and second stabilizing arms may pivot relative to the third and fourth stabilizing arms or may be fixed relative to the third and fourth stabilizing arms (i.e., the first, second, third and fourth stabilizing arms and the inner portion could all be a single integral piece or at least function as a single piece). In another arrangement, a stability member including only a single stability segment having an aperture and first and/or second stabilizing arms may be utilized between adjacent surface tiles 102. Of course, the stability member 300 may include fewer or additional stabilizing arms than shown in the figures depending on the shape and design of the building surface 101 and size and location of the predetermined gaps 226.

One method for constructing an elevated building surface assembly using the stabilizing member 300 discussed herein will now be described, although numerous other methods and manners of utilizing the stabilizing member 300 are also envisioned. Initially, a plurality of support pedestals 201 may be appropriately located upon a fixed surface with any appropriate predetermined spacing 368 between the support pedestals 201 (see FIG. 1). As appreciated by those in the art, this step may include appropriately aligning (e.g., leveling) the top surfaces 222 of the support pedestals 201 via adjusting (e.g., rotating) the base and support member extensions 214, 219 relative to each other. This step may also include appropriately aligning, orienting or adding spacer tabs 224 in a manner to allow a desired building surface 101 to be formed. As seen in FIG. 1, each support pedestal 201 may optionally have four spacer tabs 224, each being disposed at about 90° to two of the other spacer tabs 224 and at about 180° to a third other spacer tab 224 (i.e., the spacer tabs 224 may be arranged in a cross shape). This arrangement allows the top surface 222 of each support pedestal 201 to support four corner portions 110 of four surface tiles 102. However, other arrangements of spacer tabs 224 are also contemplated to allow the creation of various types of building surfaces 101.

Once the support pedestals 201 have been located on the fixed surface in the desired arrangement, surface tiles 102 may be placed on top of the support pedestals 201. That is, corner portions 110 of the surface tiles 102 may be placed on the top surface 222 of the support pedestals 201 so as to abut or nearly abut the spacer tabs 224. As seen in FIG. 3, such placement defines a predetermined gap 226 between adjacent surface tiles 102 on the support pedestals 201. However, it should be appreciated that once the entire building surface 101 has been constructed, the gap widths 227 of the various predetermined gaps 226 between adjacent surface tiles 102 may not be the same, even if the width of the spacer tabs 224 is the same. More specifically, some of the gap widths 227 of the predetermined gaps 226 may be larger than the widths of the spacer tabs 224 (e.g., due to unintended movement of the surface tiles 102). Without use of the stability member 300 discussed herein, this may result in the surface tiles 102 adjacent to such predetermined gaps 226 being more likely to move (e.g., slide laterally or move vertically) during disruptive vibrations (e.g., seismic events, foot traffic) or when subjected to high winds. Additionally, and as seen in FIG. 3, the spacer tabs 224 may not fill the entire space of the predetermined gaps 226 (i.e., the height of the spacer tabs 224 may be less than the thickness 108 of the surface tiles 102). As a result, disruptive vibrations or winds may cause a surface tile 102 to essentially "pivot" about an adjacent spacer tab 224 resulting in a top edge of one surface tile 102 abutting the top edge of an adjacent surface tile 102. Any of these situations may result in damage to surface tiles 102 and the support pedestals 201 and/or injury to pedestrians using the building surface 101.

The next step of the construction process includes locating areas on the building surface 101 where lateral and/or vertical movement between adjacent surface tiles 102 may need to be restrained or limited, and inserting at least one stabilizing arm (e.g., first and second stability segments 304, 308) into one or more predetermined gaps 226 between adjacent surface tiles 102. For instance, this may include locating a central axis of the inner portions 320, 321 of the first and second stability segments 304, 308 over the center of the top surface 222 of the support pedestals. When the support pedestals 201 cannot be seen, the user may simply align the inner portions 320, 321 over the space between the four corner portions 110 of four surface tiles 102 (e.g., note the center of the building surface 101 in FIG. 1). In any case and once so aligned, the bottom edge 324 of the first and second stability segments 304, 308 can be inserted into the predetermined gaps 226.

As seen in FIG. 3 (only first stability segment 304 being shown), at least a portion of the first stability member 304 may be thicker or wider than the predetermined gap 226 it is being inserted into (i.e., at least a portion of the first and/or second stabilizing arms 312, 316 of the first stability segment 304 may have a thickness or width greater than the gap width 227 before the first stability segment 304 is inserted into the predetermined gap 226). For instance, the first thickness 332 near the bottom edge 324 may be at least equal to or smaller than the gap width 227 of the predetermined gap 226 while the second thickness 336 near the top edge 328 may be greater than the gap width 227. In one arrangement, the first stability segment 304 may be tapered in a direction from the top edge 328 towards the bottom edge 324, and may or may not include the tile engaging elements 338. Having a portion near the bottom edge 324 of a reduced thickness compared to a portion near the top edge 328 allows the stability segment 304 to be initially at least partially inserted into the predetermined gap 226 and then further urged and compression fit between adjacent surface tiles 102.

The next step may be to further urge the first and second stability segments 304, 308 into the predetermined gaps 226 until the top edges 328 of the first and second stability segments 304, 308 are at least approximately level with or below the top surface 104 of the surface tiles 102 (see FIG. 4, one surface tile 102 has been removed for clarity). This may entail striking the first and second stability segments 304, 308 using any appropriate tool(s) (e.g., hammer, stake) so as to compression fit or wedge the first and second stability segments 304, 308 between adjacent surface tiles 102 to restrain lateral and/or vertical movement of the surface tiles 102. In one arrangement, one or more portions of the top edge 328 of the first and second stability segments 304, 308 may include notches or divots for receiving the end of a tool (e.g., stake, screwdriver) which may be struck by another tool (e.g., hammer) to facilitate driving of the first and second stability segments 304, 308 into the predetermined gaps 226. Also as part of this process, the notches 340 may fit over or otherwise receive the spacer tabs 224.

In any event, it can be seen now in FIG. 4 that the second thickness 336 of the first and second stability segments 304, 308 proximal the top edge 328 is substantially equal to or slightly greater than the gap width 227 of the predetermined gap 226 between adjacent surface tiles 102. This may result from the first and second stability segments 304, 308 being compression fit and partially deformed between the surface tiles 102. In this regard, the first and second stability segments 304, 308 may be constructed of a material (e.g., plastic) that is softer than at least the outer edge 106 of the surface tiles 102. While it appears in FIG. 4 that the height of the first and second stability segments 304, 308 is equal to the thickness 108 of the surface tiles 102, the height of the first and second stability segments 304, 308 may actually be less than the thickness 108 of the surface tiles 102 to allow the top edges 328 of the first and second stability segments 304, 308 to be disposed below the top surface 104 of the surface tiles 102. Doing so may reduce the visual footprint of the stability member 300 as well as reduce the likelihood of a pedestrian tripping on the stability member 300.

The final step may be to secure the first and second stability segments 304, 308 to the top surface 222 of the support pedestal 201. In one arrangement, a fastener 360 may be inserted through the aligned apertures of the inner portions 320, 321 of the first and second stability segments 304, 308 and into the top surface 222 of the support plate 220 of the support pedestal 201 to complete the stability member 300. For instance, the fastener 360 may be in the form of a screw that may be threaded through the central portions 320, 321 and into the support plate. Of course, the fastener 360 can be selected such that the fastener 360 can be inserted or threaded to a point where its head (not labeled) is below the top surface 104 of the surface tiles 102 for reasons discussed previously.

With continued reference to FIG. 4, while it appears that the corner portions 110 of the surface tiles 102 have been rounded so as to conform to a curved outside surface of the central portions 320, 321 of the first and second stability segments 304, 308, this need not be the case. For instance, due to the presence of the spacer tabs 224, there may naturally be a space in the middle of the pointed corners of the corner portions 110 of the four surface tiles 102 (or other number of surface tiles 102) being supported on a support pedestal 201. Thus, the inner portions 320, 321 of the first and second stability segments 304, 308 can also be wedged or compression fit into this space such that the inner portions 320, 321 deform from the shape shown in FIG. 4. In this regard, the inner portions 320, 321 may be shaped (e.g., an oval rectangular shape) to facilitate placement of the inner portions within the intersecting gaps. In some embodiments, the stability member 300 may include additional fasteners 360 (e.g., through apertures in the first and second stabilizing arms 312, 316) while in other embodiments, the stability member 300 may be attached using other means, such as an adhesive. In such arrangements, the apertures in the inner portions 320, 321 may be included with the first and second stability segments 304, 308. For example, each stabilizing arm could simply be in the form of an elongated tapered planar member. To allow interlocking between stabilizing members, each stabilizing member could have a notch sized to receive the notch of another stabilizing member.

Figure 5A:
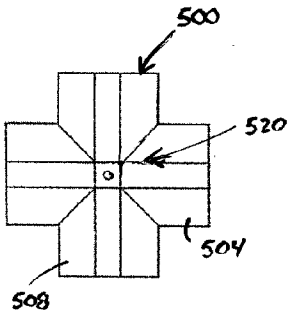
FIGS. 5(*a*) and 5(*b*) illustrate an alternative embodiment of a stabilizing member.
Figure 5B:
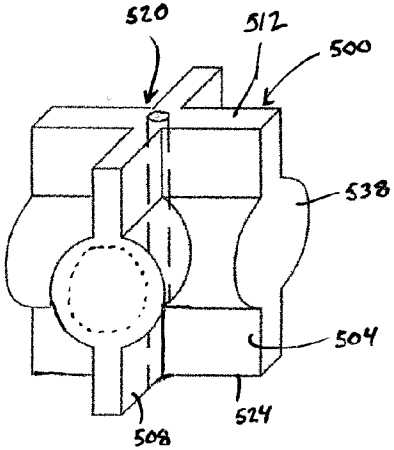

An alternative embodiment of the present invention is illustrated in FIGS. 5-8. FIGS. 5(*a*) and 5(*b*) illustrate a stability member 500 that is adapted to be disposed over the support plate 620 of a support pedestal 612. The stability member 500 includes a plurality of stabilizing arms, such as stabilizing arms 504 and 508 that extend away from an inner portion 520 of the stability member 500. The stabilizing arms include a top edge 512 and a bottom edge 524, and a tile engaging element 538 protrudes from each of the stabilizing arms 504 and 508 between the top edge 512 and the bottom edge 524. As illustrated in FIGS. 5(*a*) and 5(*b*), the tile engaging element 538 comprises an arcuate surface portion that longitudinally extends along the sides of the stabilizing arms 504, 508. Although illustrated as being a substantially solid piece, it will be appreciated that the tile engaging element may be hollow, e.g., such that a hollow portion lies adjacent to the tile engaging element 538 as is illustrated by the broken lines on stabilizing arm 508.

Figure 6:
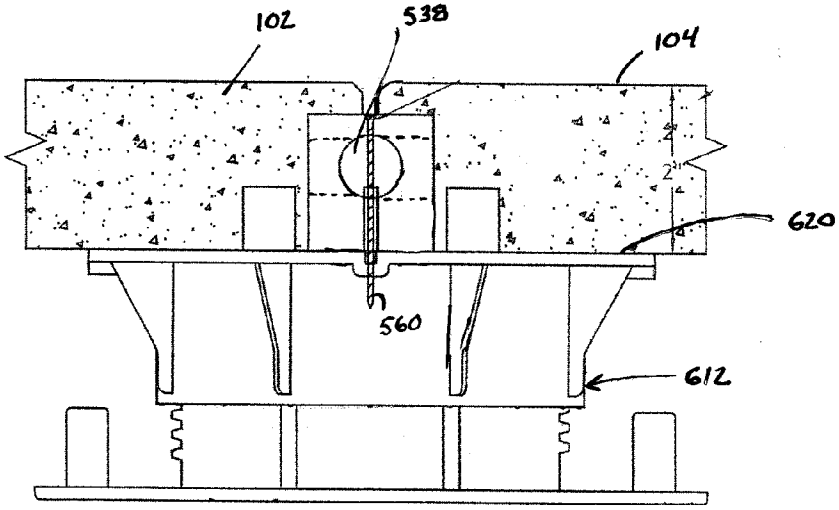
FIG. 6 illustrates a cross-sectional view of a stabilizing member and surface tiles supported by a support pedestal.

As is illustrated in FIG. 6, the tile engaging element 538 protruding from the stabilizing arm 504 may be adapted to engage with building surface tiles 102 that are placed upon the support pedestal 612. More specifically, outer edges of the surface tiles 102 may include stability member engaging portions, such as notches formed in an edge of the tile below a top surface 104. These stability member engaging portions may operatively engage with the tile engaging element 538 to restrict lateral and/or vertical movement of the surface tiles 102. For example, a notch may interconnect at least two adjacent outer edges of the building surface tiles 102. A mechanical fastener 560 may be utilized to secure the stability member 500 to the support pedestal 612.

Figure 7:
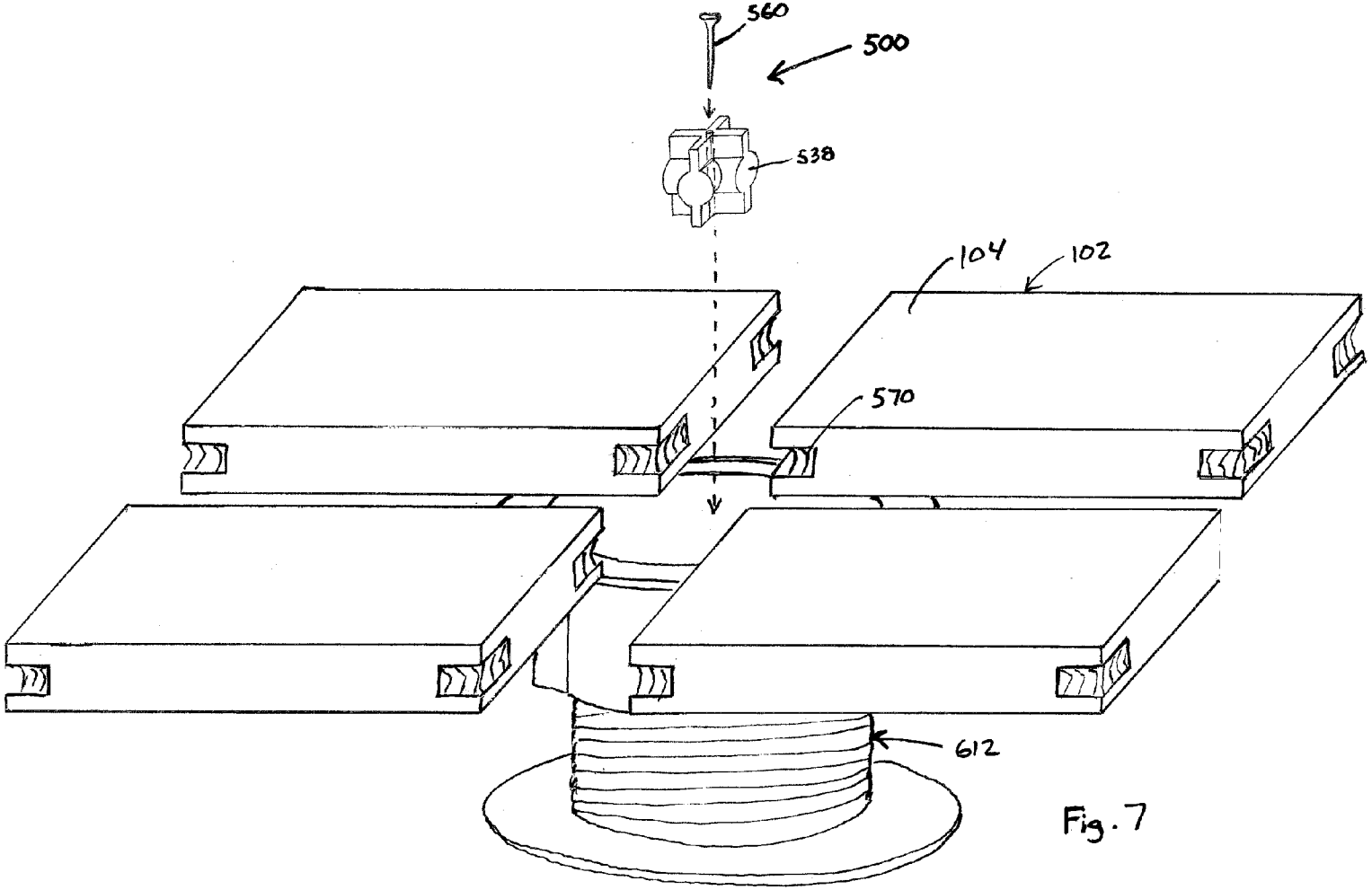
FIG. 7 illustrates a blown-up perspective view of a stabilizing member, surface tiles and a support pedestal.

FIG. 7 illustrates an exploded perspective view of a portion of an elevated building surface assembly. The assembly includes a stability member 500 substantially as described with respect to FIGS. 5*a*-5*b*. The stability member includes a tile engaging element 538 protruding from each of the stabilizing arms. The tile engaging element 538 is adapted to engage with stability member engaging portion 570 disposed in an edge of the surface tiles 102 and below a top surface 104 of the surface tiles 102. As illustrated in FIG. 7, the stability member engaging portions 570 comprise notches formed in a corner of the surface tiles 102.

Figure 8:
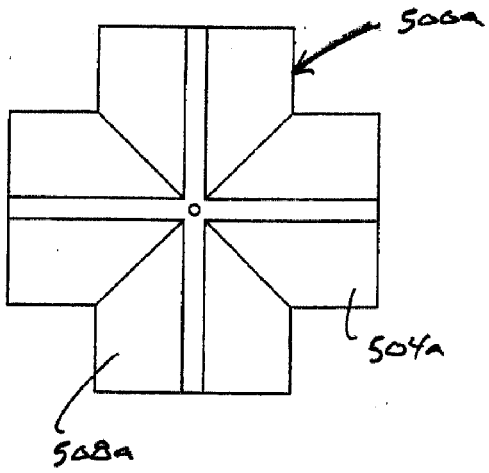
FIG. 8 illustrates another alternative embodiment of a stabilizing member.
Figure 8:
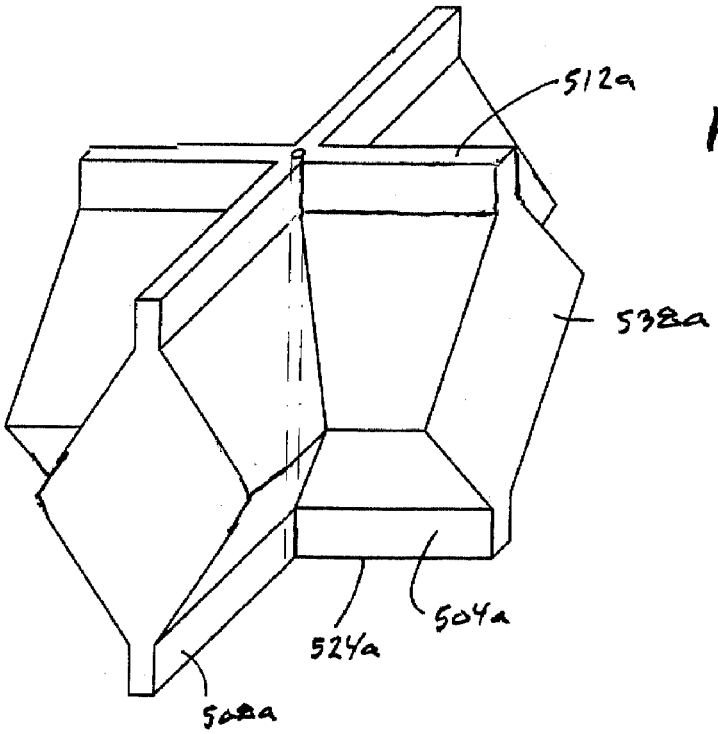

An alternative embodiment to the stability member illustrated in FIGS. 5(*a*)-5(*b*) is illustrated in FIG. 8. Here, the stability member 500*a* includes a plurality of stabilizing arms such as stabilizing arms 504*a* and 508*a*. In this example, the stabilizing arms 504*a* and 508*a* include a tile engaging element 538*a* protruding from each of the first and second stabilizing arms 504*a* and 508*a*. In this example, the tile engaging elements comprise an oblique surface portion longitudinally extending along the first and second stabilizing arms. The stability member 500*a* can be utilized to stabilize the tiles in a fashion similar to the stability member 500 illustrated in FIGS. 5-7.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. A system for supporting a plurality of building surface tiles, comprising:

a plurality of support pedestals, the support pedestals comprising a support plate having a top surface for operatively supporting corner portions of a plurality of building surface tiles in horizontally spaced-apart relation; and a plurality of stability members that are adapted to be disposed over the support plates and between building surface tiles, the stability members comprising at least first and second stabilizing arms extending away from an inner portion of the stability members, where the stabilizing arms have a top edge, a bottom edge, and at least a first tile engaging element protruding from each of the first and second stabilizing arms between the top edge and the bottom edge that is receivable within an opening in one of the corner portions of at least one of the building surface tiles.

2. The system as recited in claim 1, wherein the stabilizing arms further comprise at least a second tile engaging element protruding from each of the first and second stabilizing arms between the top edge and the bottom edge.

3. The system as recited in claim 2, wherein the first tile engaging element protrudes from a first side of the first and second stabilizing arms and the second tile engaging element protrudes from a second side of the first and second stabilizing arms.

4. The system as recited in claim 2, wherein the first and second tile engaging elements comprise longitudinally extending ribs protruding from a surface of the stabilizing arms.

5. The system as recited in claim 1, wherein the stabilizing arms comprise a hollow portion adjacent to the first tile engaging element.

6. The system as recited in claim 1, wherein the stability members comprise a vertically extending aperture disposed in the inner portion of the stability members.

7. The system as recited in claim 6, further comprising:

a plurality of mechanical fasteners adapted to be placed through the apertures to secure the stability members to the support plates.

8. The system as recited in claim 1, wherein the first and second stabilizing arms are disposed at an angle of about 180°.

9. The system as recited in claim 1, wherein the stability members further comprise third and fourth stabilizing arms extending away from the inner portion of the stability members.

10. The system as recited in claim 9, wherein the third and fourth stabilizing arms are orthogonally disposed relative to the first and second stabilizing arms.

11. The system as recited in claim 10, wherein the stability members comprise a vertically extending aperture disposed in the inner portion of the stability members.

12. The system as recited in claim 11, further comprising:

a plurality of mechanical fasteners adapted to be placed through the apertures to secure the stability members to the support plates.

13. The system as recited in claim 1, wherein the support pedestals comprise a base plate and a central section interconnecting the base plate and the support plate.

14. The system as recited in claim 1, wherein the stability members comprise a material selected from the group consisting of wood, natural stone, concrete, metal, polymers, plastic or composites thereof.

15. A system for supporting a plurality of building surfaces tiles, comprises:

a plurality of support pedestals, the support pedestals comprising a support plate having a to surface for operatively supporting corner portions of a plurality of building surface tiles in horizontally spaced-apart relation; and a plurality of stability members that are adapted to be disposed over the support plates and between building surface tiles, the stability members comprising at least first and second stabilizing arms extending away from an inner portion of the stability members, where the stabilizing arms have a top edge, a bottom edge, and at least a first tile engaging element protruding from each of the first and second stabilizing arms between the top edge and the bottom edge, and wherein the first and second tile engaging elements comprise an arcuate surface portion longitudinally extending along the first and second stabilizing arms.

16. A system for supporting a plurality of building surface tiles, comprising:

a plurality of support pedestals, the support pedestals comprising a support plate having a to surface for operatively supporting corner portions of a plurality of building surface tiles in horizontally spaced-apart relation; and a plurality of stability members that are adapted to be disposed over the support plates and between building surface tiles, the stability members comprising at least first and second stabilizing arms extending away from an inner portion of the stability members, where the stabilizing arms have a top edge, a bottom edge, and at least a first tile engaging element protruding from each of the first and second stabilizing arms between the top edge and the bottom edge, and wherein the first and second tile engaging elements comprise an oblique surface portion longitudinally extending along the first and second stabilizing arms.

17. A system for supporting a plurality of building surface tiles, comprising:

a plurality of support pedestals, the support pedestals comprising a support plate having a top surface for operatively supporting corner portions of a plurality of building surface tiles in horizontally spaced-apart relation;

a plurality of stability members comprising at least first and second stabilizing arms extending away from an inner portion of the stability members, where the stabilizing arms have a first thickness proximal to a bottom edge and a second thickness proximal to a top edge, where the second thickness is greater than the first thickness, and where each of the stabilizing arms comprises a series of tile engaging elements arranged along at least a first surface of each of the stabilizing arms between the top and bottom edges thereof; and a plurality of mechanical fasteners adapted to be placed through the inner portion of the stability members to secure the stability members to the support plates.

18. The system as recited in claim 17, wherein the support plates comprise a plurality of spacer tabs protruding upwardly from the top surface.

19. The system as recited in claim 18, wherein the second thickness of the stabilizing arms is greater than the thickness of the spacer tabs.

20. The system as recited in claim 18, wherein the stabilizing arms are adapted to be disposed over the spacer tabs.

21. The system as recited in claim 17, wherein the stabilizing arms have a height that is not greater than the thickness of the surface tiles.

22. The system as recited in claim 17, wherein the stabilizing arms have a height that is not greater than about 2 inches.

23. The system as recited in claim 17, wherein the tile engaging elements comprise longitudinally extending ribs protruding from the first surface of the stabilizing arms.

24. The system as recited in claim 17, wherein the first and second stabilizing arms are disposed at an angle of about 180°.

25. The system as recited in claim 17, wherein the plurality of stabilizing members further comprise a third stabilizing arm and a fourth stabilizing arm extending away from the inner portion of the stabilizing members.

26. The system as recited in claim 25, wherein the third and fourth stabilizing arms are orthogonally disposed relative to the first and second stabilizing arms.

27. The system as recited in claim 17, wherein the support pedestals comprise a base plate and a central section interconnecting the base plate and support plate.

28. The system as recited in claim 17, wherein the stability members comprise a material selected from the group consisting of wood, natural stone, concrete, metal, polymers, plastic or composites thereof.

29. The system as recited in claim 17, wherein the stabilizing members further comprise an aperture through the inner portion of the stability members, and wherein the mechanical fasteners are adapted to be disposed through the apertures.

30. A system for supporting a plurality of building surface tiles, comprising:

a plurality of support pedestals, the support pedestals comprising a support plate having a top surface for operatively supporting corner portions of a plurality of building surface tiles in horizontally spaced-apart relation;

a plurality of stability members comprising at least first and second stabilizing arms extending away from an inner portion of the stability members, where the stabilizing arms have a first thickness proximal to a bottom edge and a second thickness proximal to a top edge, where the second thickness is greater than the first thickness; and a plurality of mechanical fasteners adapted to be placed through the inner portion of the stability members to secure the stability members to the support plates, wherein the support plates comprise a plurality of spacer tabs protruding upwardly from the top surface, and wherein the bottom edge of the stabilizing arms comprises a notch that is adapted to be placed over the spacer tab.

31. A system for supporting a plurality of building surface tiles, comprising:

a plurality of support pedestals, the support pedestals comprising a support plate having a top surface for operatively supporting corner portions of a plurality of building surface tiles in horizontally spaced-apart relation;

a plurality of stability members comprising at least first and second stabilizing arms extending away from an inner portion of the stability members, where the stabilizing arms have a first thickness proximal to a bottom edge and a second thickness proximal to a top edge, where the second thickness is greater than the first thickness; and a plurality of mechanical fasteners adapted to be placed through the inner portion, of the stability members to secure the stability members to the support plates wherein the thickness of the stabilizing arms tapers from the top edge towards the bottom edge.

32. A system for supporting a plurality of building surface tiles, comprising:

a plurality of support pedestals, the support pedestals comprising a support plate having a to surface for operatively supporting corner portions of a plurality of building surface tiles in horizontally spaced-apart relation;

a plurality of stability members comprising at least first and second stabilizing arms extending away from an inner portion of the stability members, where the stabilizing arms have a first thickness proximal to a bottom edge and a second thickness proximal to a top edge, where the second thickness is greater than the first thickness; and a plurality of mechanical fasteners adapted to be placed through the inner portion of the stability members to secure the stability members to the support plates, wherein the plurality of stabilizing members comprise a first stabilizing element having an aperture that is adapted to be placed in vertical alignment over an aperture in a second stabilizing element.

* * * * *